United States Patent [19]

Ahn

[11] 4,392,819

[45] Jul. 12, 1983

[54] PRELIMINARY HEATING APPARATUS FOR TORCH LAMP

[76] Inventor: Byorg R. Ahn, Room 706, Daekyo Apt.-1,1-892 Yoido-Dong, Seoul, Rep. of Korea

[21] Appl. No.: 228,522

[22] Filed: Jan. 26, 1981

[30] Foreign Application Priority Data

Feb. 22, 1980 [KR] Rep. of Korea ..... 1083/80[U]

[51] Int. Cl.[3] ..... F23D 11/44

[52] U.S. Cl. ..... 431/231; 431/277

[58] Field of Search ..... 431/231, 232, 230, 277

[56] References Cited

U.S. PATENT DOCUMENTS

| | | | |
|---|---|---|---|
| 1,466,403 | 8/1923 | Knapp | 431/277 |
| 1,849,110 | 3/1932 | Pagel | 431/231 |
| 2,285,689 | 6/1942 | Tullis | 431/231 |
| 3,817,684 | 6/1974 | Sell | 431/277 X |

*Primary Examiner*—Edward G. Favors

*Attorney, Agent, or Firm*—Jordan and Hamburg

[57] ABSTRACT

A torch lamp having a fuel container, an evaporation section and a handle for supporting the container. A spouting body is attached to the fuel pouring hole in the container. The spouting body is provided with an ignition device and an adjusting valve. A supply pipe extends from the spouting body into the container.

1 Claim, 2 Drawing Figures

PRELIMINARY HEATING APPARATUS FOR TORCH LAMP

Detailed Explanation of the Utility Model

Figure 1:
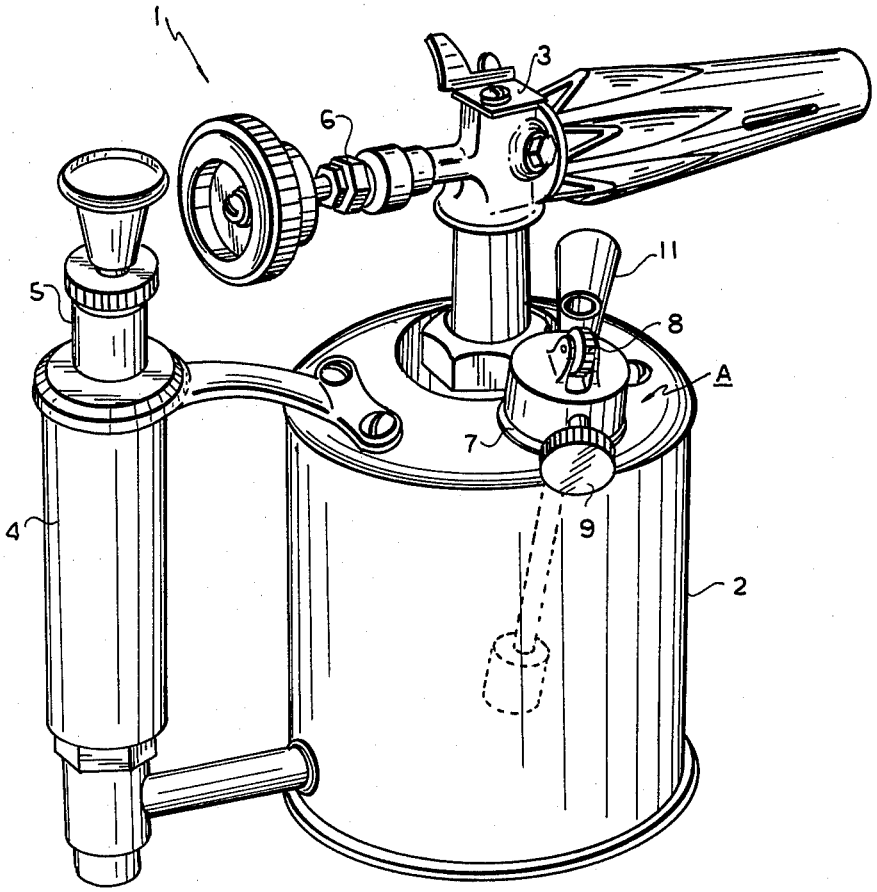
FIG. 1 : Shows whole strabismal view of the present device installed.
Figure 2:
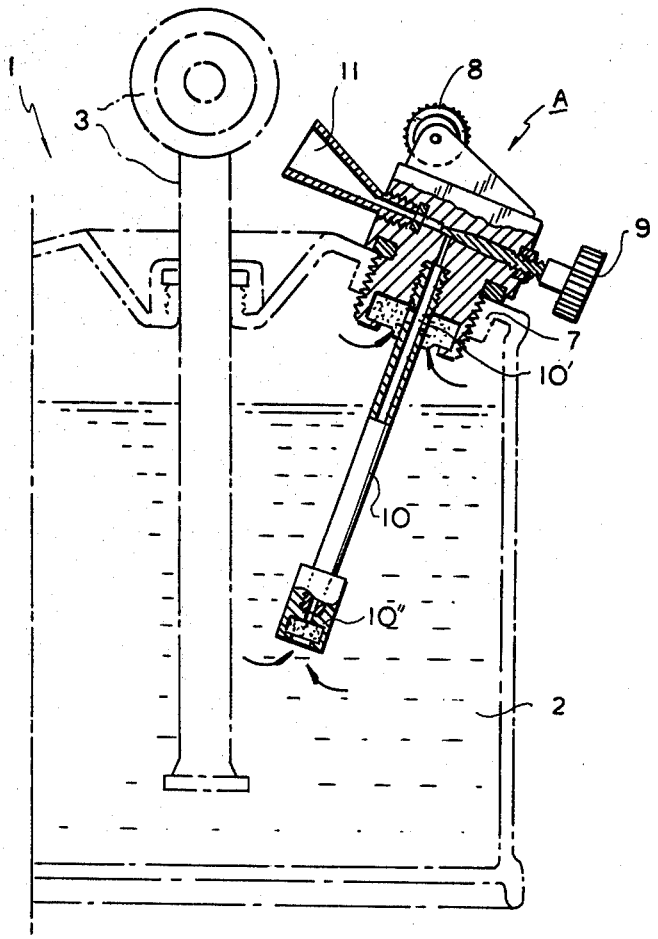
FIG. 2 : Shows cross-sectional view of the present device installed.

Present invention relates to an apparatus of preliminary heat for the torch lamp of petroleum use.

When speak of the conventional torch lamp, an evaporation section was installed at the upper middle part of the fuel container, and comprised a compressor in the portion of handle.

In order for ignition of the torch lamp thus composed, it was necessary to open the fuel valve of evaporation section to allow the fuel flow out, and much soot was originated until enough heating of the evaporation section to be made. Thus, there was such defect as blackening the whole portion of the evaporation section.

In view of the defects that the conventional torch lamp gives, in this invention, a separate preliminary heating apparatus was provided at the side part of the upper portion of the fuel container.

According to this redevised apparatus, the petroleum contained in the container is spouted out to the evaporation section through the spouting pipe of the preliminary heating apparatus, in the mixed state with the compressed air, by the compressed air having been injected into the fuel container.

As the evaporation section is to be heated this way, the torch lamp can be used without occurance of the soot. The detailed illustration concerning the attached drawings is as follows:

In addition to the publicly known device of the torch lamp where the evaporation section(3) was fixed to the upper middle part of the fuel container(2) and the compressor(5) to the inside of the handle(4), and adjustment of switch be made by fuel valve(6), a spouting body(A) in which an ignition device(8) and adjusting valve(9) were fixed, are installed in place of the lid of the fuel pouring hole(7) arranged at the side of upper portion of the fuel container(2). From this spouting body(A) are linked a supplying pipe(10) which is of orifice(10') adjacent to the spouting body(A) and the orifice(10'') at the end of the supplying pipe(10) situated near to the bottom part of the fuel container(2). The part(11) not explained is spouting pipe.

According to this invention thus constituted, when adjusting valve (9) is released after the air inside of the fuel container(2) was compressed by way of pumping, the petroleum ascends through the supplying pipe(10).

Simultaneously, the air kept in the fuel container(2) is discharged with strong pressure through the orifice(10') arranged at the upper end of the supplying pipe(10).

When the above pregress is made, the mixed petroleum with compressed air spouts toward the evaporation section(3) from the spouting pipe(11) in the state of particle.

When ignition is given by the ignition device(8), the evaporation section(3) gets heated as if it were heated by gas lighter. When the evaporation section(3) is sufficiently heated, the adjusting valve(9) is closed while pumping is given by the pump(5). Then, the ascending fuel to the evaporation section(3) comes to be directly burnt to function the normal burner without producing any soot.

The preliminary heating device of this invention can, therefore, be conveniently used for the burner used for the purpose of leisure life, kitchen work, and industrial affairs without any separated gas or alcohol for the preliminary heat.

What is claimed is:

1. Torch lamp comprising a fuel container for receiving fuel therein, evaporation means mounted on the outside of said fuel container and receiving fuel from said fuel container, a fuel valve connected to said evaporation means for controlling the fuel passing through said evaporation means, a compressor mounted on the outside of said fuel container for supplying compressed air to said fuel container, whereby compressed air in said fuel container is operable to force the fuel in said fuel container out through said evaporation means, said compressor having an elongated section functioning as a handle for handling the torch, a pouring hole in said fuel container for supplying fuel to said fuel container, preliminary heating means removably mounted in said pouring hole, said preliminary heating means being positioned for heating said evaporating means prior to operating the lamp to evaporate fuel, said preliminary heating means comprising a body disposed in said pouring hole, a supply pipe connected at one end to said body and extending downwardly therefrom into said fuel container, said supply pipe having at least one bottom orifice opening into the inside of said fuel container for receiving fuel from the inside of said fuel container and at least one upper orifice opening into the inside of said fuel container for receiving compressed air from the inside of said fuel container, said preliminary heating means further comprising an adjusting valve for regulating fuel and air through said supply pipe, a spouting pipe connected to said body and having an opening adjacent to said evaporation means so that when said adjusting valve is opened, fuel under pressure flows from said bottom orifice located in said fuel container and compressed air under pressure flows from said upper orifice located in said fuel container into said supply pipe to said body and thence through said open adjusting valve to exit through said spouting pipe, and ignition means mounted on said body for igniting the fuel at the spouting pipe such that burning fuel from said spouting pipe thereby heats the evaporating means until the evaporating means is sufficiently heated to support combustion of fuel supplied by way of said fuel valve.

* * * * *